US006614399B2

(12) United States Patent
Trumbull et al.

(10) Patent No.: US 6,614,399 B2
(45) Date of Patent: Sep. 2, 2003

(54) MULTI-BAND COMPACT TUNABLE DIRECTIONAL ANTENNA FOR WIRELESS COMMUNICATION DEVICES

(75) Inventors: Thomas Trumbull, Redwood Estates, CA (US); Patrick McKivergan, Scotts Valley, CA (US)

(73) Assignee: Tyco Electronics Logistics AG (CH)

( * ) Notice: Subject to any disclaimer, the term of this patent is extended or adjusted under 35 U.S.C. 154(b) by 41 days.

(21) Appl. No.: 09/749,045

(22) Filed: Dec. 26, 2000

(65) Prior Publication Data

US 2002/0080078 A1 Jun. 27, 2002

(51) Int. Cl.[7] ..... H01Q 1/24
(52) U.S. Cl. ..... 343/702; 343/700 MS
(58) Field of Search ..... 343/700 MS, 702, 343/846, 745, 749; H01Q 1/24, 1/36, 1/38

(56) References Cited

U.S. PATENT DOCUMENTS 5,467,095 A * 11/1995 Rodal et al. ..... 34/700 MS
5,917,450 A * 6/1999 Tsunekawa et al. .. 343/700 MS
6,337,664 B1 * 1/2002 Mayes et al. ..... 343/749

OTHER PUBLICATIONS

Straw, R. Dean, et al. (eds.), *The Antenna Book*, 19th ed., ARRL, Newington, CT., 2000, Chap. VII, "Multiband Antennas," pp. 7–1–7–28.

* cited by examiner

*Primary Examiner*—Michael C. Wimer
(74) *Attorney, Agent, or Firm*—Fulbright & Jaworski L.L.P.

(57) ABSTRACT

An antenna for wireless communication devices provides resonance over at least two frequency bands with a directional radiation pattern and reduced specific absorption rate (SAR). The antenna structure includes of a formed conducting plate resonator spaced from a larger substantially rectangular ground plane conductor. The antenna structure can be located near one end of ground plane conductor. Single feed and ground connections are provided on adjacent edges of the resonator. Two or more tuning capacitors cause the resonator to resonate over two or more frequency ranges. Tuning of the higher frequency band may be done without affecting the lower frequency band in the case of a dual band version. The sizes and shape of the resonator and ground plane are compatible with the dimensions of wireless communications devices such as cell phones. The resonator may be conveniently installed internally at the top rear of a wireless communications device, providing substantial front to back ratio in the antenna radiation pattern, reducing the specific absorption rate (SAR) for devices, such as cell phones positioned close to a user's head or body when in use.

34 Claims, 9 Drawing Sheets

Channel: S21
Rotation: Elevation

DUT Description:
300201
Pol: Horizontal

RangeStar BC#2
Automated Antenna
and Cellphone
Measurment System

| Freq (MHz) | Trace | Beam Deg | Peak dB |
|---|---|---|---|
| 890.00 | ——— | +3.63 | +0.16 |
| 900.00 | ——— | +3.63 | +0.61 |
| 912.00 | ——— | +3.63 | +1.01 |
| 924.00 | ——— | -1.07 | +1.21 |

| Freq (MHz) | Trace | Beam Deg | Peak dB |
|---|---|---|---|
| 936.00 | — — | -1.07 | +1.04 |
| 948.00 | — — | -1.07 | +0.94 |
| 960.00 | — — | -5.76 | +0.03 |

| Freq (MHz) | Trace | Beam Deg | Peak dB | Freq (MHz) | Trace | Beam Deg | Peak dB |
|---|---|---|---|---|---|---|---|
| 1850.00 | ——— | +31.74 | +0.82 | 1923.00 | —— — | +31.74 | +1.74 |
| 1880.00 | ——— | +31.74 | +1.07 | 1930.00 | —— — | +36.43 | +0.71 |
| 1910.00 | ——— | +36.43 | +1.79 | 1960.00 | —— — | +36.43 | +2.73 |
| 1917.00 | ——— | +36.43 | +1.85 | 1990.00 | —— — | +36.43 | +1.82 |

MULTI-BAND COMPACT TUNABLE DIRECTIONAL ANTENNA FOR WIRELESS COMMUNICATION DEVICES

TECHNICAL FIELD

This invention is generally related to wireless communications devices, and more particularly to multi-band antennas for wireless communications devices.

BACKGROUND

Wireless communications devices such as cellular phones, personal communication service ("PCS") phones, pagers, and cellular modems are increasing in popularity and becoming ever more prevalent. Not only are the number of wireless communications devices increasing, but also the variety of devices and the types of available services are increasing. For example, many wireless communications devices now offer data services such as Internet access, in addition to voice and/or text messaging services.

Wireless communications devices typically employ one or more antennas and a receiver, transmitter or transceiver for providing wireless communications. These devices operate by emitting and/or receiving radio frequency (RF) radiation at a variety of frequency bands of the electro-magnetic spectrum. Reference herein to RF radiation and/or RF signals refers to operation in any portion of the electromagnetic spectrum suitable to wireless communications, not only the portion typically associated with the AM and FM radio bands. For example, cellular operation typically occurs in the 800–900 MHz range and PCS operation typically occurs in the 1.85–1.99 GHz range.

While wireless communications devices offer their users considerable convenience, current devices suffer from a number a possible drawbacks. For example, some have expressed concern regarding possible adverse effects from radiation, particularly where the wireless communications device is located close to the user's head or body when in use. Antennas such as multi band dipole or asymmetric dipole antennas have an omni-directional free space radiation pattern, providing as much radiation in a front direction (i.e., toward the user's head) as it provides in a back direction (i.e., away from the user's head). Multi-band antennas (PIFA) provides little or no directivity, thus similarly exposing the user to undesired radiation levels.

Wireless communications employ a variety of operating protocols and frequency bands. The ability of a wireless communications device to employ more than one operating protocol and/or frequency band is important to the success of the device in the marketplace.

The size of wireless communications devices is important to their acceptance in the marketplace. The size is in part, a function of the number, size and shape of the antennas used for wireless communications.

SUMMARY OF THE INVENTION

In one aspect, a compact multi-band resonator is designed for internal mounting within a wireless communications device, for example, on one side of and near one end of the printed circuit board of the wireless communications device. The relatively small size of the resonator permits it to be integrated within the interior region of a wireless communications device such as a cellular phone. The resonator may have one or more curved edges that conform to a curved top edge of the plastic housing of a wireless communications device. The resonator is fed against, and works in conjunction with, a second planar conductor formed, for example, by the ground traces of the printed circuit board to form a moderately directional antenna with dipole gain. For example, directivity exhibited when tuned for the cellular and PCS bands may be on the order of 3 dB far field front to back ratio in the low frequency (cellular) band, and 7 dB in the higher frequency (PCS) band. This directivity may result in a reduction in the near field, thereby reducing the specific absorption rate ("SAR") when the antenna is installed on the top rear of a wireless communications device such as a cellular phone operated near the head in the talk position. The antenna structure can include a feed point that presents a 50 ohm unbalanced impedance for connection to the wireless communications device's transmit/receive circuitry via a single hot conductor and a single ground conductor.

In another aspect, each of the frequency bands of the multi-band antenna are separately tunable. At least one discrete capacitance between a resonator and a ground plane conductor can be adjusted to tune the frequency band of the antenna. In another aspect, the higher frequency band may be tuned without affecting the lower frequency band.

In a further aspect, at least one capacitance is remotely adjustable. The capacitors can be made variable by techniques such as switched fixed capacitors which are selected by PIN diodes or by using voltage-controlled capacitors ("varactors"). In either case, the capacitance value may be controlled electrically or by a digital command signal. The command signal may originate at a site remote from the wireless communications device, such as a cell site or base station, which facilitates seamless roaming across cellular service regions having different frequency allocations for particular bands, as an example.

DETAILED DESCRIPTION OF THE DRAWINGS

In the following description, certain specific details are set forth in order to provide a thorough understanding of various embodiments of the invention. However, one skilled in the art will understand that the invention may be practiced without these details. In other instances, well-known structures associated with wireless communications devices such as processors, transmitters, receivers, transceivers, memory, keypads, displays, and communications protocols, have not been described in detail to avoid unnecessarily obscuring the descriptions of the embodiments of the invention.

Unless the context requires otherwise, throughout the specification and claims which follow, the word "comprise" and variations thereof, such as "comprises" and "comprising" are to be construed in an open, inclusive sense, that is as "including but not limited to."

Figure 1:
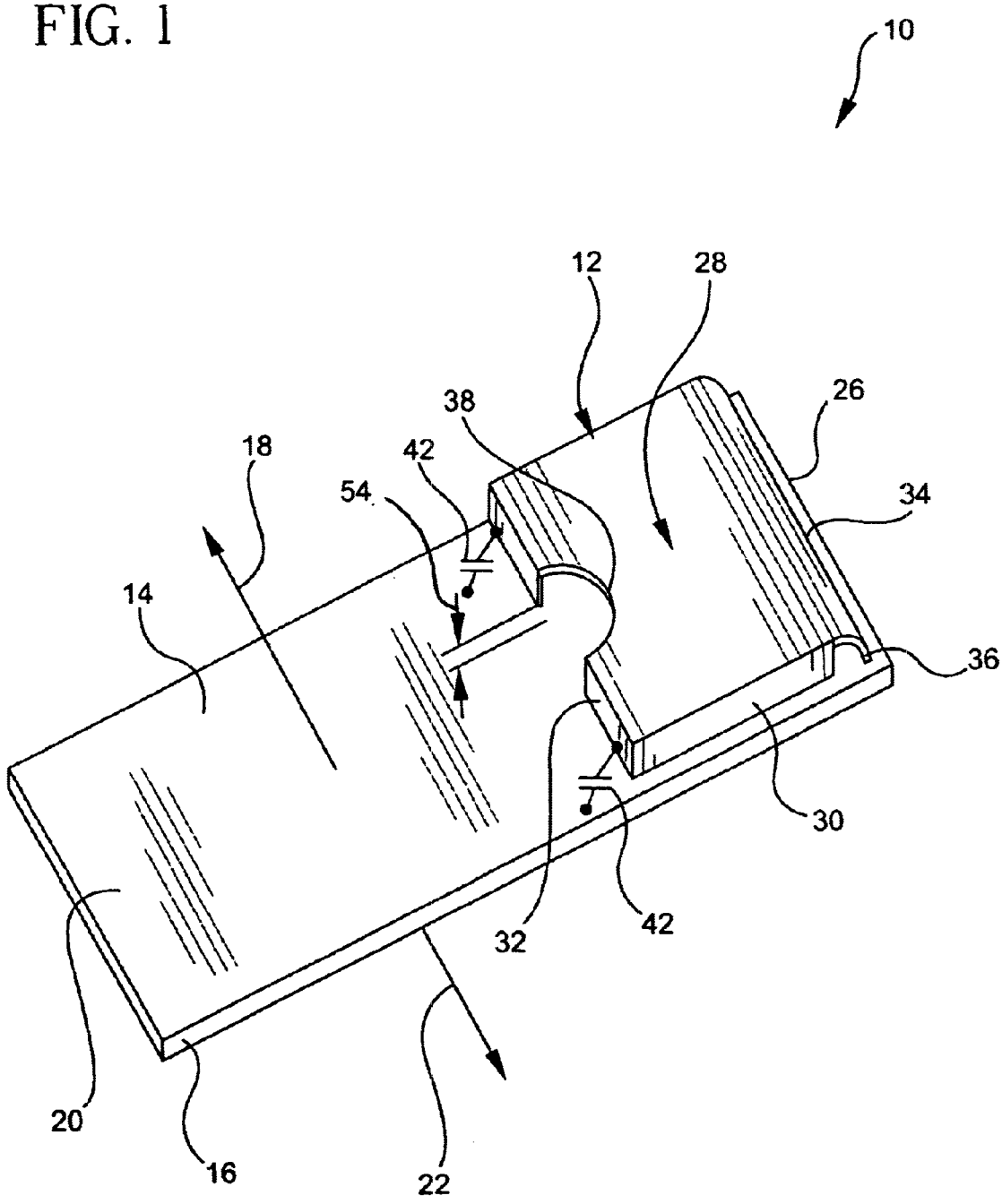
FIG. 1 is a front, right, top perspective view of one embodiment of an antenna structure for a wireless communications device according to the present invention.
Figure 2:
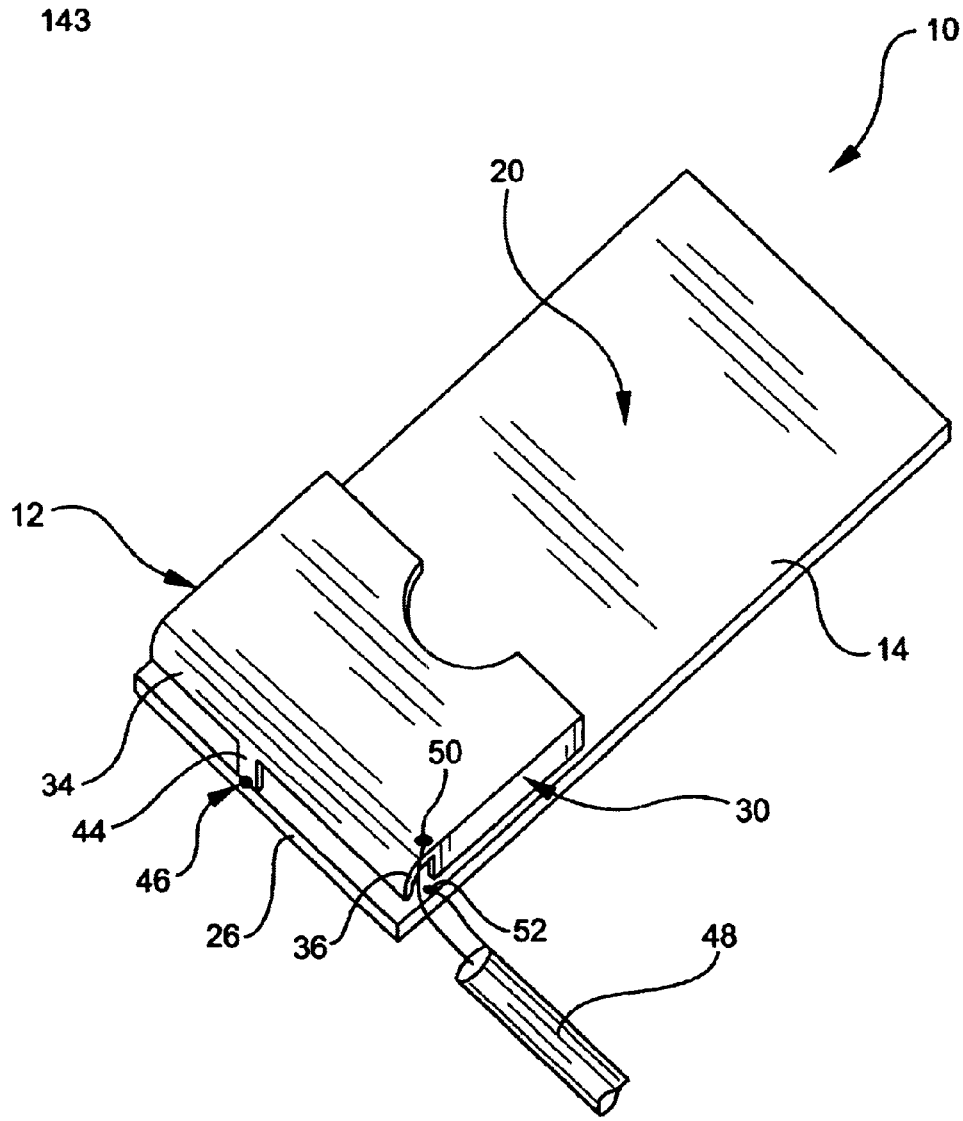
FIG. 2 is a front, left, rear perspective view of the embodiment of the antenna structure of FIG. 1
Figure 3:
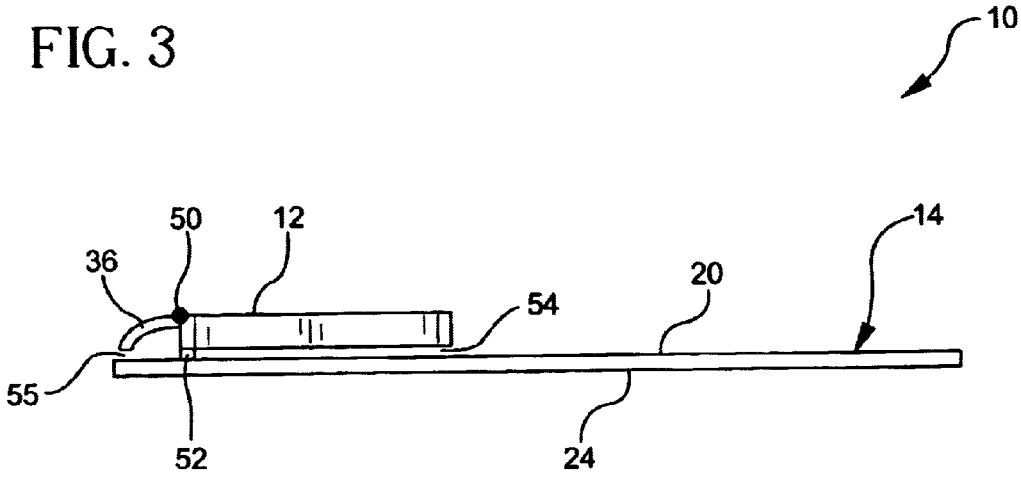
FIG. 3 is a left side elevation view of the embodiment of the antenna structure of FIGS. 1 and 2

FIGS. 1–3 show a dual-band embodiment of a multi-band antenna structure 10. The antenna structure 10 includes a resonator 12 and a generally planar conductor that serves as a ground plane conductor 14 for the antenna structure 10. One or more conductive traces (not shown) on a surface or within a printed circuit board ("PCB") 16 can serve as the ground plane conductor 14. Alternatively, or additionally, a conductive patch carried on the surface or within the PCB 16 can form the ground plane conductor 14.

The resonator 12 is located on one side of the ground plane conductor 14. The position of the resonator 12 with respect to the ground plane conductor 14 defines an orientation for the antenna structure 10. A front arrow 18 extending outward from the surface 20 of the ground plane conductor 14 carrying the resonator 12 indicates a front direction. A back arrow 22 extending in the opposite direction, that is the back direction extends outward from the surface 24 (FIG. 3) of the ground plane conductor 14 that does not carry the resonator 12, indicates a back direction. Additionally, the resonator 12 is generally positioned close to a top end 26 of the ground plane conductor 14, which can provide a beneficial reduction in radiation exposure when installed in a wireless communications devices, as explained below.

The resonator 12 has a conducting plate portion 28 which is spaced from the ground plane conductor 14. The resonator 12 also has a pair of opposed side portions 30 (one visible in FIG. 1, the other visible in FIG. 2), extending from the conducting plate portion 28 toward the ground plane conductor 14. The resonator 12 also has a bottom end conducting portion 32 that can be formed as two legs extending from the conducting plate portion 28 toward the ground plane conductor 14. The resonator 12 further includes a top end conducting portion 34 extending from the conducting plate portion 28 toward the ground plane conductor 14. The top end conducting portion 34 can optionally be formed with a smooth curve 36 to accommodate or conform to a wireless communications device housing. Alternatively, the top end conducting portion 34 can be formed with an angle or relatively sharp edge at the junction with the conducting plate portion 28.

The conducting plate portion 28 can optionally include a curved recess 38 located between the legs forming the bottom end conducting portion 32. The curved recess 38 may provide approximately 8% wider bandwidth in the higher frequency range of operation of the antenna structure 10.

The conducting portions 28, 30, 32, 34 of the resonator 12 can, for example, be formed of sheet metal or metal on plastic. Suitable results are achieved using conducting portions 28, 30, 32, 34 having a thickness in the range or approximately 0.0005–0.06 inches, although other thickness may also be suitable. The resonator 12 can be formed in a single step operation by, for example, stamping a piece of sheet metal to form the various conducting portions 28, 30, 32, 34. Alternatively, a multi-step process can be employed. For example, one step can include forming conductor non-receptive surfaces of a non-conductive support by injection molding using a first material. Another step can include forming conductor receptive surfaces of the non-conductive support by injection molding employing a second material. Additional steps can include layering of conductive material on the various conductor receptive surfaces of the non-conductive support. Layering may take the form of plating or other method of attaching the conductive material to the conductor receptive surfaces of the non-conductive support.

A first discrete capacitance 40, shown schematically, tunes a higher frequency band of the antenna structure 10. A second discrete capacitance 42, also shown schematically, tunes a lower frequency band of the antenna structure 10. These capacitances 40, 42 can be supplied by fixed type capacitors, such as chip capacitors, or by variable type capacitors, such as manually adjusted or voltage-controlled capacitors. Adjustments made to the value of capacitance 40 do not affect the lower frequency band, while adjustments made to the value of the second capacitance 42 affect both frequency bands.

With specific reference to FIG. 2, a ground electrical connection between the resonator 12 and the ground plane conductor 14 is made via a leg 44 at a point 46. The antenna structure 10 is electrically coupled to a signal source (not shown) via a low impedance feed-line 48. The feed-line 48 is coupled to the resonator 12 and the ground plane conductor 14 at connection points 50, 52, respectively. The low-impedance feed-line 48 can take the form of a low impedance coaxial line such as that shown in FIG. 2, although other feed-lines are suitable, such as a microstrip feed-line. The connection points 50, 52 are adjacent surfaces of the resonator 12 and the ground plane conductor 14. The distance between the connection point 12 and the first capacitance 40 is shorter than the distance between the connection point 12 and the second capacitance 42.

With specific reference to FIG. 3, a space 54 is maintained between the side and bottom end conducting portions 30, 32 of the resonator 12 and ground plane conductor 14. A space 55 is also maintained between the top end conducting portion 34 of the resonator 12 and the ground plane conductor 14. For example, an appropriate dielectric support such as a plastic material may carry the conducting portions 28, 30, 32, 34 of the resonator 12 on the surface 20 of the ground plane conductor 14. Alternatively, the leg 44 can serve as a cantilever support for the resonator 12.

Figure 4:
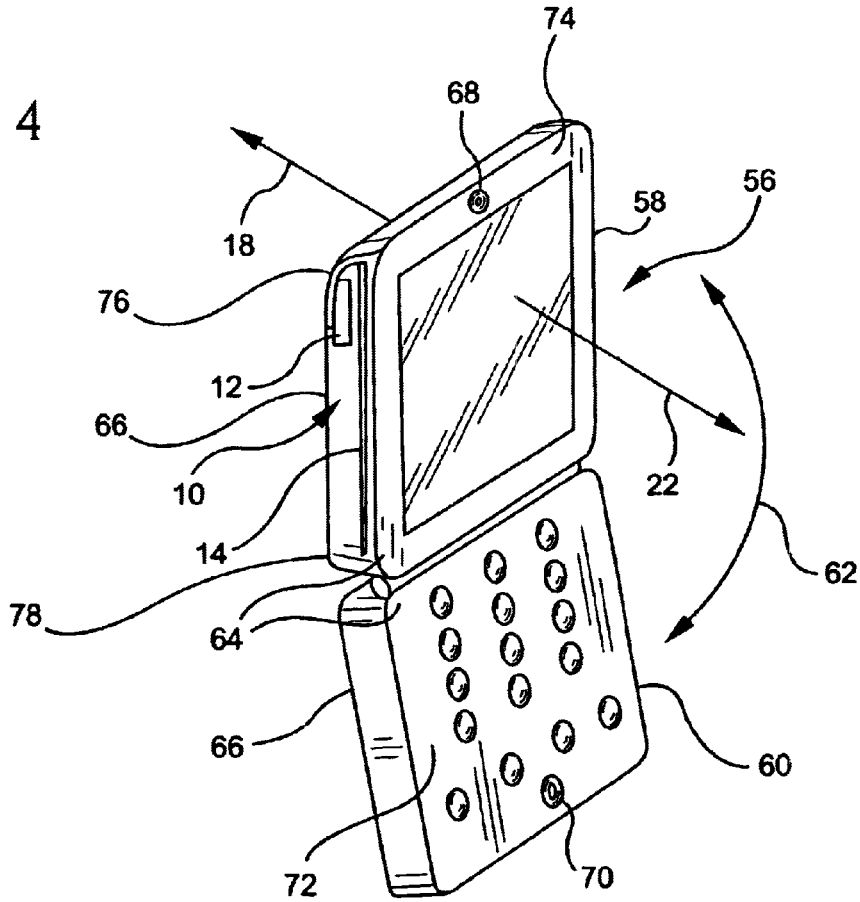
FIG. 4 is a front, left, top view perspective view of a wireless communications device, having a transparent left side to show the position of the antenna structure of FIGS. 1–3 within a housing of the wireless communications device.
Figure 5:
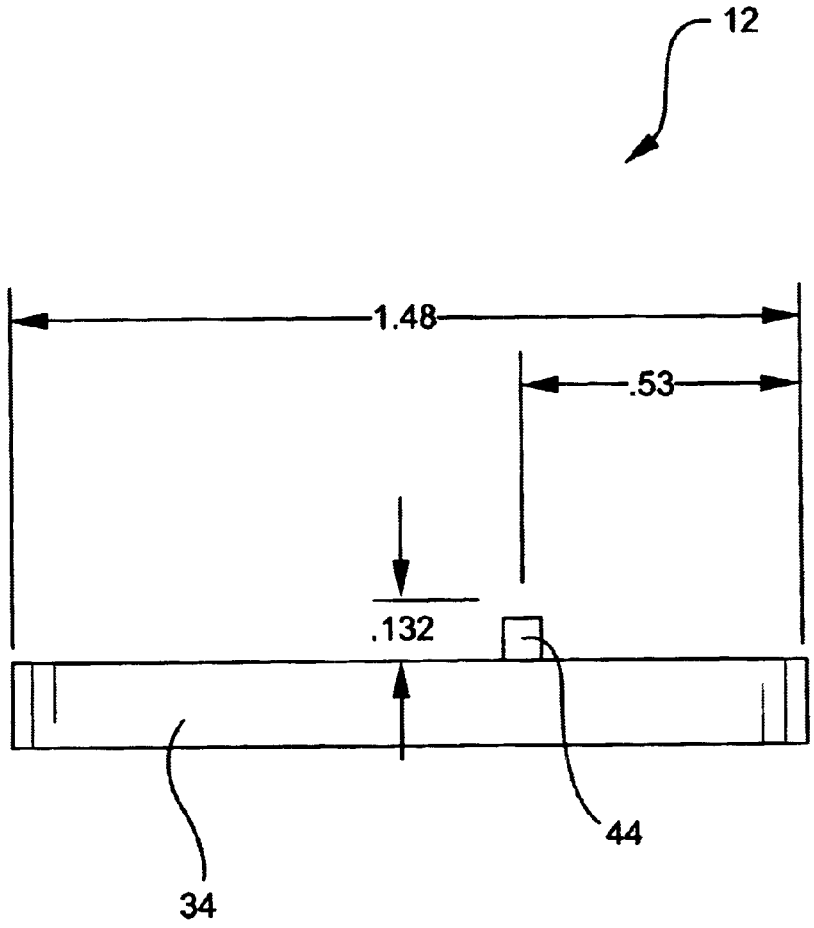
FIG. 5 is a top elevational view of a resonator of the antenna structure of FIGS. 1–3, showing specific dimensions for operating in the 880–960 Mhz and 1850–1990 MHz bands.
Figure 6:
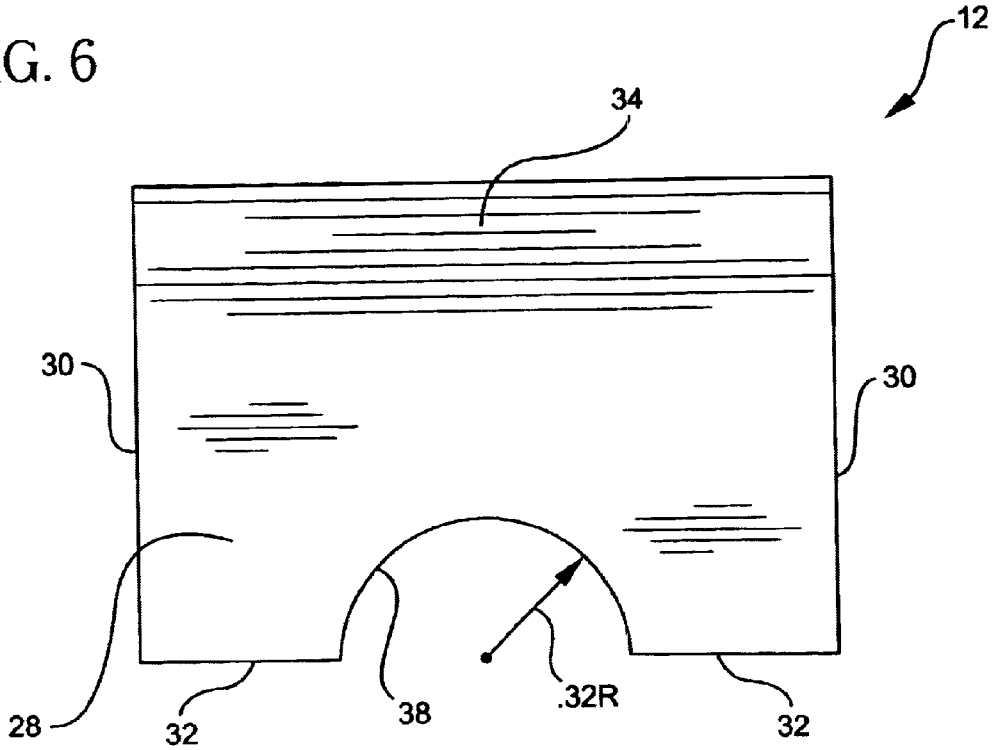
FIG. 6 is a front plan of the resonator of FIG. 5.
Figure 7:
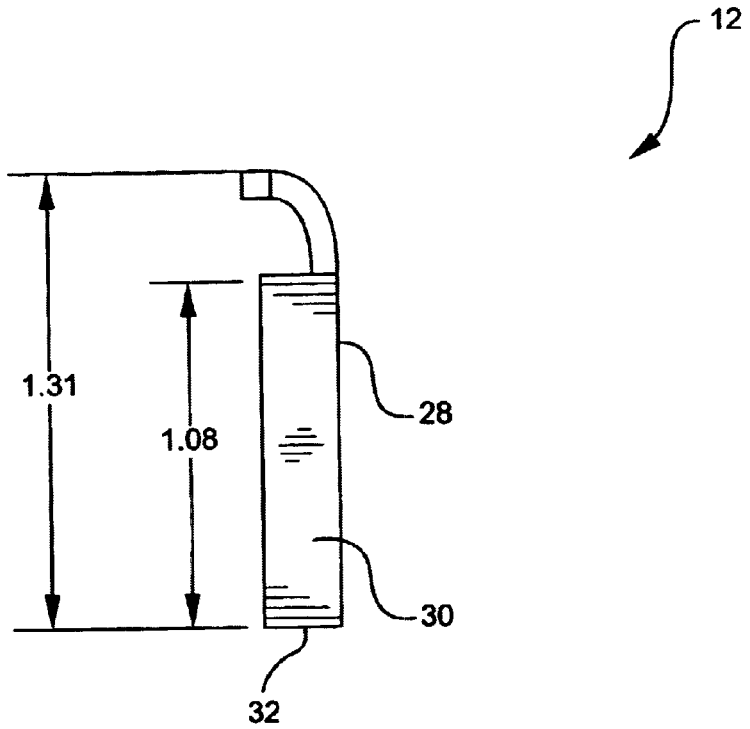
FIG. 7 is a left side elevational view of the resonator of FIGS. 5 and 6.
Figure 8:
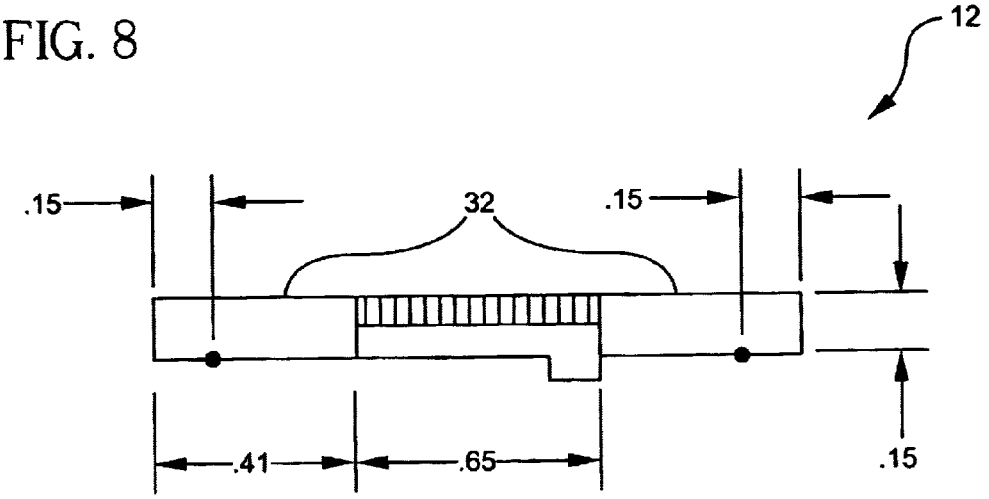
FIG. 8 is a bottom elevational of the resonator of FIGS. 5–7.
Figure 9:
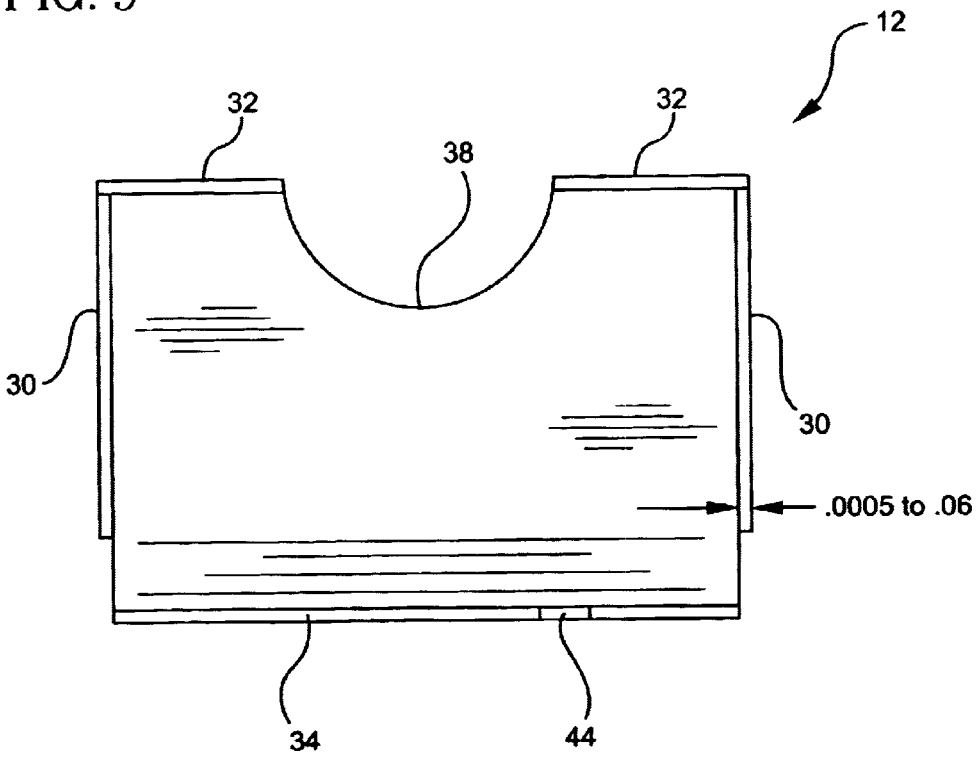
FIG. 9 is a back plan view of the resonator of FIGS. 5–8.

FIG. 4 shows a wireless communications device 56 employing the antenna structure 10 of FIGS. 1–3. The wireless communications device 56 is illustrated in a deployed position, with the two portions 58, 60 of the communications device 56 rotated or folded away from one another. Such a communications device 56 can have the two portions 58, 60 folded together as indicated by double-headed arrow 62, such that a front side 64 of each portion 58, 60 is adjacent one another to create a shorter configuration for storage. In other embodiments, the wireless communications device may be of unitary construction, such that the device does not fold into a smaller configuration.

The conducting plate portion 28 of the resonator 12 faces a rear side 66 of portion 58 of the wireless communications device 56, while the ground plane faces the front side 64 of the portion 58. The conducting plate portion 28 is preferably proximate the rear side 66 of portion 58. The front arrow 18 illustrates the front direction with respect to wireless transmissions from the communications device 56, while the back arrow 22 illustrates the back direction. Typically, a user's head is in close proximity to the wireless communications device 56 while the device is in operation. Thus, the user is subjected to radiation emitted in the direction indicated by the back arrow 22.

The wireless communications device 56 can include a speaker 68 for producing sound and microphone 70 for receiving sounds. A keypad 72 can allow a user to dial a telephone number, or enter data and/or instructions. A display 74, such as a liquid crystal diode display, can provide data and/or a menu of commands to a user. Similar structure and functionality is common in current cellular phones and/or PCS phones. Attention is drawn to the way that the top end conducting portion 34 of the resonator 12 conforms to a curved top end portion 76 of the housing 78 of the wireless communications device 56.

In operation, the capacitance 40, 42 of the antenna structure 10 can be adjusted based on a signal received by the wireless communications device 56. The signal can originate from a selection of a switch or key 72 by the user of the wireless communications device 56, or can originate externally from the wireless communications device 56, such as a signal received via a cellular site or base station. For example, a digital command provided by a cellular network can automatically cause the wireless communications device 56 to adjust the value of one and/or both of the capacitances 40, 42, to permit roaming between areas having different frequency bands and/or operating protocols. The automatic switching can be implemented by applying a selected voltage to one or more pin diodes to select a particular capacitor, or by applying a selected voltage to one or more varactors. For example, dual band operation can occur in pairs of frequency bands such as: 824–894/1850–1990 MHz, 824–894/1710–1850 MHz., and/or 880–960/1850–1990 MHz.

FIGS. 5–9 show a specific embodiment of the resonator 12 having dimensions suitable for operation over the 880–960 MHz and 1850–1990 MHz bands. Dimensions for the corresponding ground plane conductor 14 are 1.48 inches wide by 4.45 inches long. The thickness of the corresponding ground plane conductor 14 may be in the range 0.0005–0.5 inches. The preferred capacitor values for these frequency ranges are in the range 0.25–0.7 pf for the first capacitance 40 and in the range 0.6–2 pf for the second capacitance 42.

The resonator 12 has an approximate length of 1.48 inches and width of 1.31 inches, where the conducting plate portion 28 of the resonator 12 has an approximate width of 1.08 inches. The curved recess 38 of the conducting plate portion 28 has a radius of approximately 0.32 inches. The thickness of the conducting portions 28, 30, 32, 34 is approximately 0.0005–0.06 inches. The first and second discrete capacitances 40, 42 are located approximately 0.15 inches from the outer edges of the bottom end conducting portion 32. The leg has an approximate length of 0.132 inches, which corresponds to the spacing 54 (FIG. 3). An end of the top end conducting portion 34 is spaced approximately 0.04 inches from the ground plane conductor 14, corresponding to the spacing 55 (FIG. 3).

Figure 10:
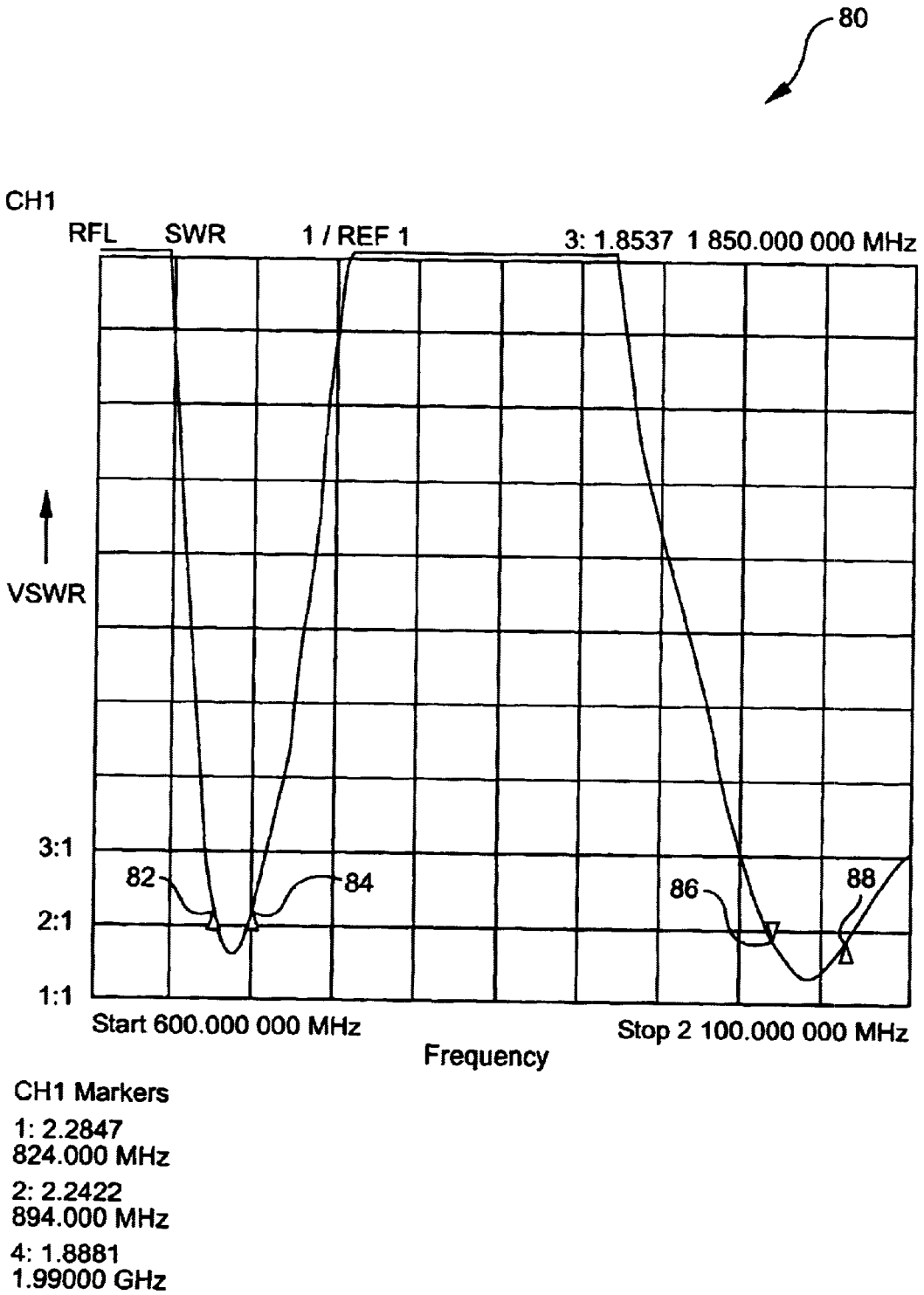
FIG. 10 shows a plot of VSWR vs. frequency for one embodiment of the antenna structure.

FIG. 10 shows a plot of VSWR versus frequency 80 for one embodiment of the antenna structure 10 having dimensions as set out in FIGS. 5–9. Acceptable levels are achieved simultaneously over two frequency bands, as indicated by the marker arrows 82, 84, 86, 88.

Figure 11:
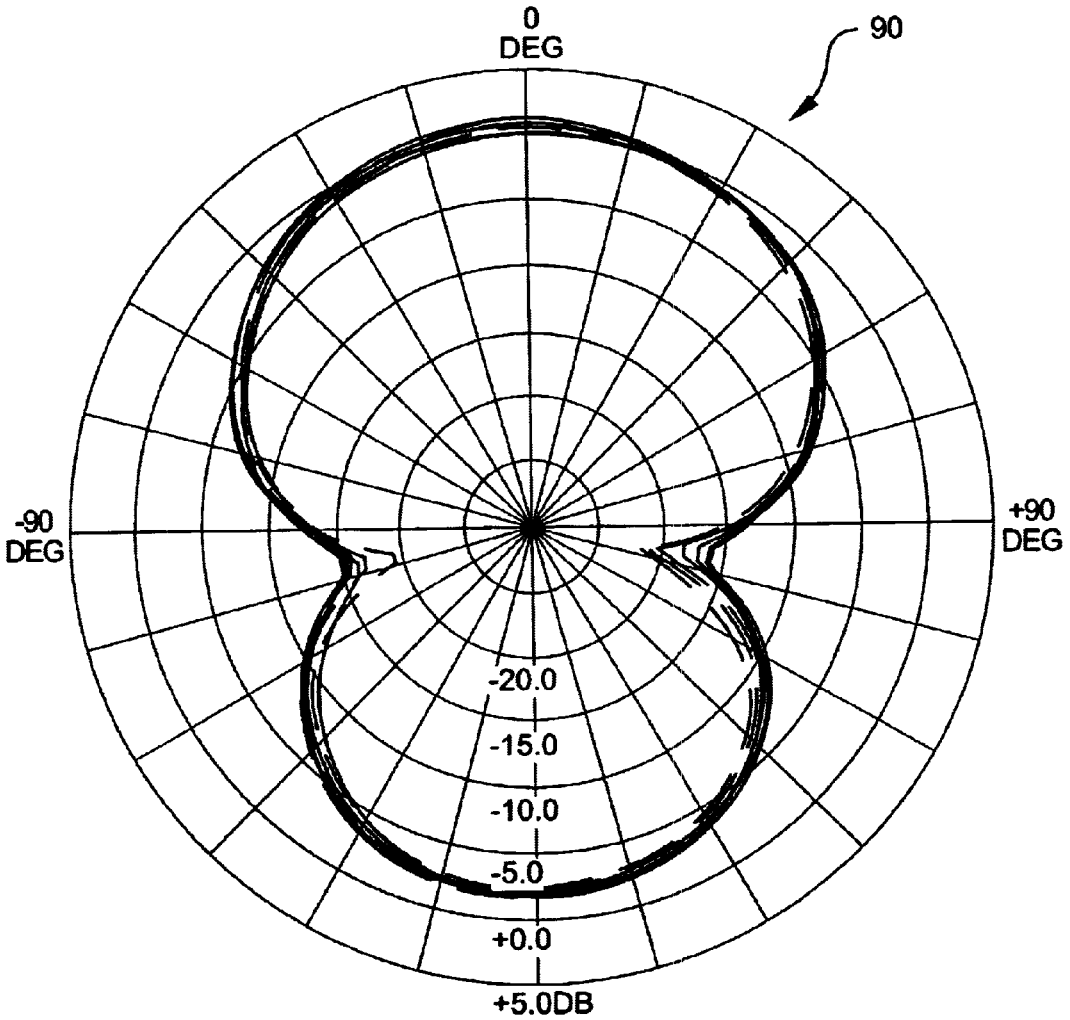
FIG. 11 shows a lower frequency band antenna radiation pattern for one embodiment of the antenna structure.

FIG. 11 shows elevation plane radiation patterns 90 for the lower frequency band, and for one embodiment of the antenna structure 10 having dimensions as set out in FIGS. 5–9. Peak gain is +1.2 dBi and front to back ratio is approximately 3 dB.

Figure 12:
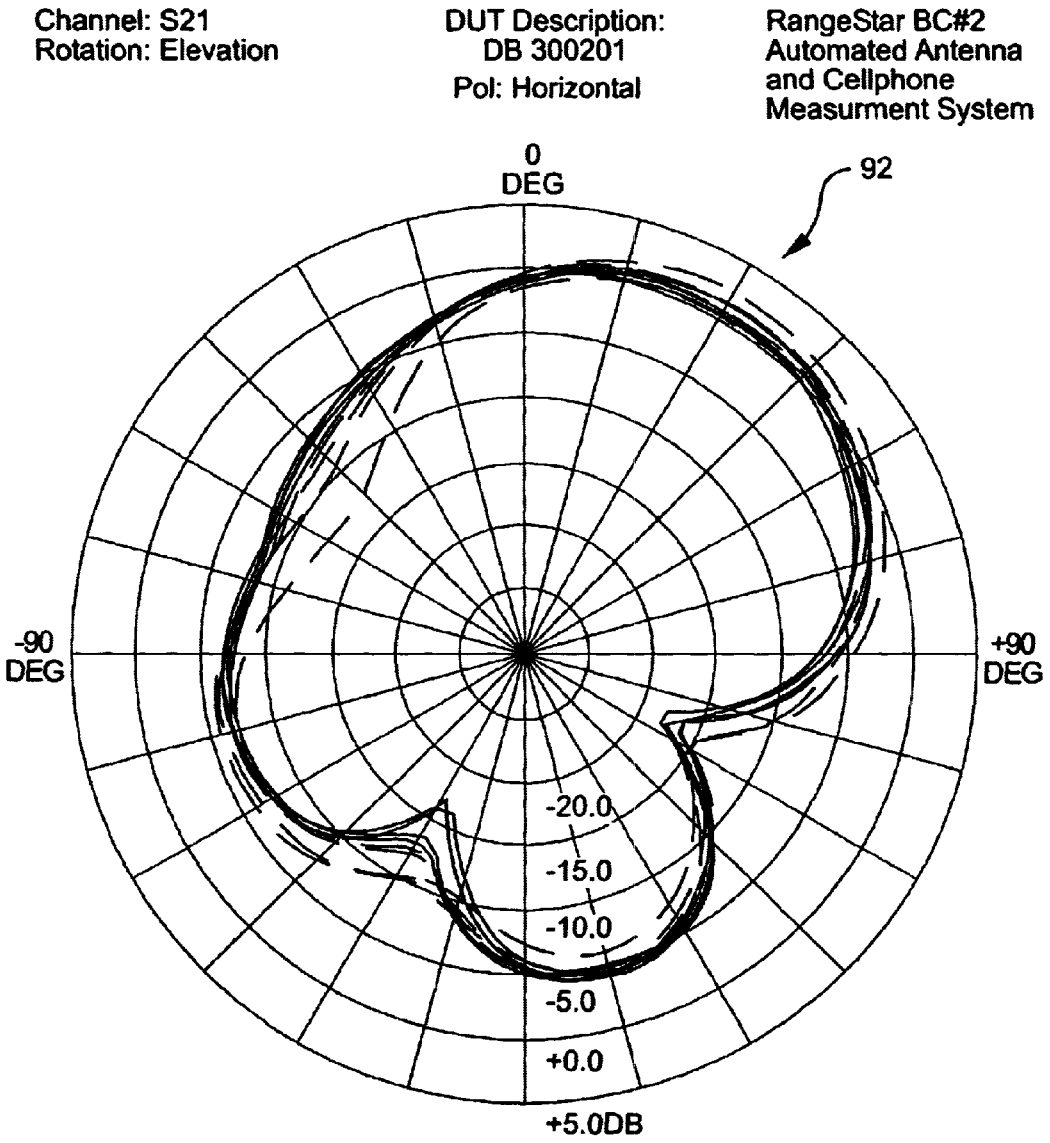
FIG. 12 shows a higher frequency band antenna radiation pattern for one embodiment of the antenna structure.

FIG. 12 shows elevation plane radiation patterns 92 for the higher frequency band, and for one embodiment of the antenna structure 10 having dimensions as set out in FIGS. 5–9. Peak gain is +2.1 dBi, and front to back ratio is approximately 6 dB.

Although specific embodiments, and examples for, the invention are described herein for illustrative purposes, various equivalent modifications can be made without departing from the spirit and scope of the invention, as will be recognized by those skilled in the relevant art. The teachings provided herein of the invention can be applied to other wireless communications device. For example, antennas may be configured to operate at three or more frequency bands, or at frequency bands other than those given as examples above. The various embodiments described above can be combined to provide further embodiments. Additionally, or alternatively, the described methods can omit some steps, can add other steps, and can execute the steps in other orders to achieve the advantages of the invention.

These and other changes can be made to the invention in light of the above detailed description. In general, in the following claims, the terms used should not be construed to limit the invention to the specific embodiments disclosed in the specification, but should be construed to include all wireless communications devices, antenna structures and resonators that operate in accordance with the claims. Accordingly, the invention is not limited by the disclosure, but instead its scope is to be determined entirely by the following claims.

What is claimed is:

1. An antenna for a portable wireless device, said antenna comprising:

a ground plane conductor elongated in a first dimension and having an upper edge and a lower edge and a pair of side edges between said upper edge and lower edge;

a resonator having a conducting plate portion closely spaced at an upper portion to the ground plane, said resonator having an upper edge and a lower edge, said upper edge being proximate to the upper edge of the ground plane conductor, said resonator extending substantially between the pair of side edges, the resonator being electrically coupled proximate to the upper edge of the ground plane conductor;

a first discrete capacitance electrically coupled between the ground plane conductor and the resonator at said lower edge of the resonator and spaced from a feed connection point on the resonator by a first distance; and a second discrete capacitance electrically coupled between the ground plane conductor and the resonator at said lower edge of the resonator and spaced from the feed connection point on the resonator by a second distance, the second distance being different than the first distance.

2. The antenna of claim 1 wherein the resonator has an opposed pair of conducting side portions extending from a periphery of the conducting plate portion of the resonator towards the ground plane conductor and an opposed pair of conducting end portions extending from the periphery of the conducting plate portion between towards the ground plane conductor, each of the conducting end portions positioned between the conducting side portions.

3. The antenna of claim 1 wherein the resonator has an opposed pair of conducting side portions extending from a periphery of the conducting plate portion of the resonator towards the ground plane conductor and an opposed pair of conducting end portions extending from the periphery of the conducting plate portion towards the ground plane conductor, each of the conducting end portions positioned between the conducting side portions, where a transition between the conducting plate portion and one of the conducting end portions forms a smooth curve.

4. The antenna of claim 1 wherein a periphery of the conducting plate portion of the resonator has a pair of opposing sides edges, a top edge between the side edges and a bottom edge opposing the top edge, the resonator having an opposed pair of conducting side portions, each of the side portions extending from a respective one of the side edges towards the ground plane conductor, a conducting top end portion extending from the top edge towards the ground plane conductor, and at least one bottom end conducting portion extending from the bottom edge towards the ground plane conductor.

5. The antenna of claim 1 wherein a periphery of the conducting plate portion of the resonator has a pair of opposing sides edges, a top edge between the side edges and a bottom edge opposing the top edge, the resonator having an opposed pair of conducting side portions, each of the side portions extending from a respective one of the side edges towards the ground plane conductor, a conducting top end portion extending from the top edge towards the ground plane conductor, and at least two bottom end conducting portions extending from the bottom edge towards the ground plane conductor, the bottom edge of the conducting plate portion frowning a curved recess between the two bottom end conducting portions.

6. The antenna of claim 1 wherein the resonator is formed as a single stamped metal plate.

7. The antenna of claim 1 wherein the resonator is formed by at least one conductive layers carried by a single non-conductive injection molded support structure.

8. The antenna of claim 1 wherein the ground plane is formed by at least one of a conductive trace carried by a circuit board.

9. The antenna of claim 1 wherein the ground plane is formed by a conductive pad carried on a surface of a circuit board.

10. The antenna of claim 1 wherein at least one of the first and the second discrete capacitances are variable capacitances.

11. The antenna of claim 1 wherein at least one of the first and the second discrete capacitances comprises at least two fixed capacitors switched by way of a number of pin diodes.

12. The antenna of claim 1 wherein at least one of the first discrete capacitance and the second discrete capacitance is a varactor.

13. An antenna structure, comprising:

a conducting ground plane element elongated in a first dimension and having an upper edge and a lower edge and a pair of side edges between said upper edge and lower edge;

a conducting plate portion spaced in proximity to the upper edge of the ground plane element and spanning substantially between the side edges of the ground plane element, said plate portion being coupled to a signal line proximate the upper edge of the ground plane element;

a pair of opposed side portions extending from the conducting plate portion at an approximately right angle in a first direction;

a conducting top end portion extending from the conducting plate portion in the first direction and positioned between the pair of opposed side portions, said conducting top portion being coupled to the ground plane element proximate the upper edge; and a conducting bottom end portion extending from the conducting plate portion in the first direction and positioned between the pair of opposed side portions and opposed from the top end portion.

14. The resonator of claim 13 wherein a transition between the conducting plate portion and the top end portion forms a smooth radius.

15. The resonator of claim 13 wherein the bottom end portion forms two legs and the conducting plate portion forms a curved recess between the two legs of the bottom end portion.

16. The resonator of claim 13 wherein the conducting plate portion, side portions, top end portion and bottom end portions are formed as a single stamped metal plate.

17. The resonator of claim 13 wherein the conducting plate portion, side portions, top end portion and bottom end portions are formed as at least one conductive material layer over a single non-conductive injection molded support structure.

18. An antenna structure for installation in a wireless communications device, comprising:

a ground plane conductor elongated in a first dimension and having an upper edge and a lower edge and a pair of side edges between said upper edge and lower edge;

a resonator having a conducting plate portion spaced from the ground plane, a pair of opposed side portions extending from the conducting plate portion toward the ground plane, each one of said pair of opposed side portions being generally adjacent one of the pair of side edges of the ground plane conductor, a top end portion extending from the conducting plate portion toward the ground plane between the pair of opposed side portions, said top end portion being generally adjacent the upper edge of the ground plane conductor, and a bottom end portion extending from the conducting plate portion toward the ground plane between the pair of opposed side portions and opposed to the top end portion, the resonator being electrically coupled to the ground plane at said top end portion;

a first discrete capacitance electrically coupled between the ground plane conductor and the resonator; and a second discrete capacitance electrically coupled between the ground plane conductor and the resonator, wherein at least one of the first and the second discrete capacitances is adjustable.

19. The antenna structure of claim 18 wherein the first discrete capacitance is spaced from a feed connection point on the resonator by a distance greater than the spacing of the second discrete capacitance from the feed connection point on the resonator.

20. The antenna structure of claim 18 wherein the bottom end portion forms a first leg and a second leg.

21. The antenna structure of claim 18 wherein the bottom end portion forms a first leg and a second leg and the conducting plate portion forms a curved recess positioned between the first and the second legs.

22. The antenna structure of claim 18 wherein a portion of the resonator at a junction of the conducting plate portion and the top end portion forms a smooth bend to conform to a portion of the wireless communications device.

23. A wireless communications device, comprising:

a ground plane conductor elongated in a first dimension and having an upper edge and a lower edge and a pair of side edges between said upper and lower edges;

a resonator having a conducting plate portion spaced from the ground plane, a pair of opposed side portions extending from the conducting plate portion toward the ground plane, each of said pair of opposed side portions being generally adjacent one of the pair of side edges of the ground plane conductor, a top end portion extending from the conducting plate portion toward the ground plane between the pair of opposed side portions, said top end portion being generally adjacent the upper edge of the ground plane conductor, and a bottom end portion extending from the conducting plate portion toward the ground plane between the pair of opposed side portions and opposed to the top end portion, the resonator being electrically coupled to the ground plane at said top end portion;

a first discrete capacitance electrically coupled between the ground plane conductor and the resonator; and a second discrete capacitance electrically coupled between the ground plane conductor and the resonator, wherein at least one of the first and the second discrete capacitances is adjustable;

a transmitter; and a signal line electrically coupling the transmitter to the ground plane and the resonator.

24. The wireless communications device of claim 23 wherein the signal line is a coaxial feed line.

25. The wireless communications device of claim 23 wherein the signal line is a microstrip feed line.

26. The wireless communications device of claim 23, further comprising:

a voltage controller coupled to at least one of the capacitances to selectively adjust a voltage to vary the capacitance.

27. The wireless communications device of claim 23, further comprising:

a wireless receiver for receiving external wireless communications;

a voltage controller coupled the wireless receiver and to at least one of the capacitances to selectively adjust a voltage to vary the capacitance in response to an external command received by the wireless receiver.

28. The wireless communications device of claim 23 wherein the resonator is proximate a top, rear of the wireless communications device.

29. The wireless communications device of claim 23 wherein the ground plane conductor is positioned toward a front of the wireless communications device with respect to the resonator.

30. The wireless communications device of claim 23 wherein the ground plane conductor is positioned between a user's head and the resonator when the wireless communications device is configured for use.

31. A method of producing an antenna structure, comprising:

providing a conductive ground plane elongated in a first dimension and having an upper edge and a lower edge and a pair of side edges between said upper edge and said lower edge;

forming a resonator having a conducting plate portion, said resonator having an upper edge and a pair of opposed side portions;

closely spacing the conducting plate portion of the resonator from the conductive ground plane so that said upper edge of the resonator is generally adjacent the upper edge of the conductive ground plane and each one of said pair of opposed side portions are generally adjacent one of the pair of side edges of the conductive ground plane;

electrically coupling a first discrete capacitance between the resonator and the ground plane at a first distance from a feed connection point on the resonator; and electrically coupling a second discrete capacitance between the resonator and the ground plane at a second distance from a feed connection point on the resonator, different than the first distance.

32. A method comprising:

providing a conductive ground plane elongated in a first dimension and having an upper edge and a lower edge and a pair of side edges between said upper edge and said lower edge;

forming a resonator having a conducting plate portion spaced from the ground plane, a pair of opposed side portions extending from the conducting plate portion toward the ground plane, each one of said pair of opposed side portions being generally adjacent one of the pair of side edges of the ground plane conductor, a top end portion extending from the conducting plate portion toward the ground plane between the pair of opposed side portions, said top end portion being generally adjacent the upper edge of the ground plane conductor, and a bottom end portion extending from the conducting plate portion toward the ground plane between the pair of opposed side portions and opposed to the top end portion, the resonator being electrically coupled to the ground plane at said top end portion;

electrically coupling a first discrete capacitance electrically coupled between the ground plane conductor and the resonator;

electrically coupling a second discrete capacitance electrically coupled between the ground plane conductor and the resonator;

receiving an externally originated wireless signal at a wireless communications device; and automatically adjusting either or both of the first discrete capacitance and the second discrete capacitance based on the received wireless signal to adjust the operational band of the antenna structure.

33. The method of claim 32 wherein adjusting a capacitance includes modifying a voltage applied to a varactor.

34. The method of claim 32 wherein adjusting a capacitance includes modifying a voltage applied to a pin diode to select at least one of a number of capacitors.

* * * * *